US010307819B2

(12) United States Patent
Brugger et al.

(10) Patent No.: US 10,307,819 B2
(45) Date of Patent: Jun. 4, 2019

(54) SEMI-CONTINUOUS CASTING OF A STEEL STRIP

(71) Applicant: Primetals Technologies Austria GmbH, Linz (AT)

(72) Inventors: Christian Brugger, Linz (AT); Susanne Hahn, Linz (AT); Jens Kluge, Aichach (DE); Hans-Peter Kogler, Traun (AT); Johann Poeppl, Kirchschlag (AT); Guoxin Shan, Leoben (AT); Susanne Tanzer, Leonding (AT); Heinrich Thoene, Linz (AT); Franz Wimmer, Riedau (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 197 days.

(21) Appl. No.: 15/129,576

(22) PCT Filed: Jan. 27, 2015

(86) PCT No.: PCT/EP2015/051619
§ 371 (c)(1),
(2) Date: Sep. 27, 2016

(87) PCT Pub. No.: WO2015/079071
PCT Pub. Date: Jun. 4, 2015

(65) Prior Publication Data

US 2017/0216908 A1 Aug. 3, 2017

(30) Foreign Application Priority Data

Mar. 27, 2014 (EP) ..... 14162061

(51) Int. Cl.
*B22D 11/041* (2006.01)
*B22D 11/055* (2006.01)
(Continued)

(52) U.S. Cl.
CPC ..... *B22D 11/041* (2013.01); *B22D 11/055* (2013.01); *B22D 11/124* (2013.01);
(Continued)

(58) Field of Classification Search
CPC ..... B22D 11/041; B22D 11/055; B22D 11/12; B22D 11/1213; B22D 11/124;
(Continued)

(56) References Cited

U.S. PATENT DOCUMENTS 4,658,882 A 4/1987 Oba et al.
9,254,520 B2 2/2016 Dittenberger et al.
(Continued)

FOREIGN PATENT DOCUMENTS

CN 101300092 A 11/2008
CN 102773427 A 11/2012
(Continued)

OTHER PUBLICATIONS

Notice of Opposition dated Apr. 6, 2018 issued in corresponding European Patent Application No. 15702712.9 (without English translation).
(Continued)

*Primary Examiner* — Kevin P Kerns
(74) *Attorney, Agent, or Firm* — Ostrolenk Faber LLP

(57) ABSTRACT

A method for semi-continuous casting of a strand of steel in a strand casting machine and a strand casting machine that carries out the method, the method includes pouring liquid steel into a mold while closing off the mold by a bar to form a fully solidified strand start area followed by a partially solidified strand; extracting the partially solidified strand from the mold; supporting and guiding the partially solidified strand in the strand guide; at the end of the casting, ending the pouring of liquid steel into the mold and forming a strand end; extracting the strand end from the mold; ending
(Continued)

the extraction of the strand end; ending the secondary cooling; providing controlled or regulated cooling of the partially solidified strand until full solidification of the strand; and discharging the strand from the strand casting machine.

18 Claims, 10 Drawing Sheets

(51) Int. Cl.
*B22D 11/12* (2006.01)
*B22D 11/124* (2006.01)
*B22D 11/128* (2006.01)
*B22D 11/22* (2006.01)

(52) U.S. Cl.
CPC ..... *B22D 11/1213* (2013.01); *B22D 11/1281* (2013.01); *B22D 11/225* (2013.01)

(58) Field of Classification Search
CPC ... B22D 11/128; B22D 11/1281; B22D 11/22; B22D 11/225
USPC ..... 164/454, 455, 462, 484, 486, 413, 414, 164/425, 444, 445
See application file for complete search history.

(56) References Cited

U.S. PATENT DOCUMENTS

| | | | | |
|---|---|---|---|---|
| 9,802,245 | B2 | 10/2017 | Wagstaff et al. | |
| 2006/0032559 | A1* | 2/2006 | Mikubo et al. ..... | B22D 11/003 148/551 |
| 2014/0290899 | A1 | 10/2014 | Dittenberger et al. | |

FOREIGN PATENT DOCUMENTS

| | | | | | |
|---|---|---|---|---|---|
| CN | 202606822 | U | | 12/2012 | |
| CN | 103706769 | | | 4/2014 | |
| DE | 20 42 546 | A1 | | 3/1972 | |
| DE | 31 50 684 | A1 | | 7/1983 | |
| DE | 35 42 518 | | | 6/1987 | |
| DE | 3621234 | | | 1/1988 | |
| DE | 41 08 785 | A1 | | 9/1991 | |
| GB | 2 117 684 | | | 10/1983 | |
| GB | 2242148 | B | | 5/1994 | |
| JP | S59-45068 | A | | 3/1984 | |
| JP | S62-197250 | A | | 8/1987 | |
| JP | 10-216911 | A | * | 8/1998 | ..... B22D 11/126 |
| KR | 10-1053975 | B1 | | 8/2011 | |
| RU | 2187408 | C2 | | 8/2002 | |
| SU | 261660 | A1 | | 12/1977 | |
| SU | 980935 | A1 | | 12/1982 | |
| SU | 1675033 | A1 | | 9/1991 | |
| WO | WO 2013/083391 | A1 | | 6/2013 | |
| WO | WO 2013/174512 | A2 | | 11/2013 | |

OTHER PUBLICATIONS

International Search Report dated May 22, 2015 issued in corresponding International patent application No. PCT/EP2015/051619.
Written Opinion dated May 22, 2015 issued in corresponding International patent application No. PCT/EP2015/051619.
Austrian Search Report dated Aug. 10, 2016 issued in Austrian patent application A 50052/2015.
Office Action with Search Report dated Nov. 16, 2017 in corresponding Chinese Patent Application No. 201580016900.8 (total 20 pages).
Donald J. Hurtuk, "Steel Ingot Casting," ASM Handbook, vol. 15: Casting, 2008, pp. 911-917, DOI:10.1361/asmhba0005295.
Office Action dated Jun. 28, 2018 issued in corresponding Russian Patent Application No. 2016141648/02 (066749) (without English translation).

* cited by examiner

Temperature [°C]
+1.495e+03
+1.415e+03
+1.300e+03
+1.186e+03
+1.071e+03
+9.567e+02
+8.421e+02
+7.275e+02
+6.129e+02
+4.983e+02
+3.838e+02
+2.692e+02
+1.546e+02
+4.000e+01
T1
T2
T3
T4
T5
T6
T7
T8
T9
T10
T11
T12
T13
9
1
y FIG 7A
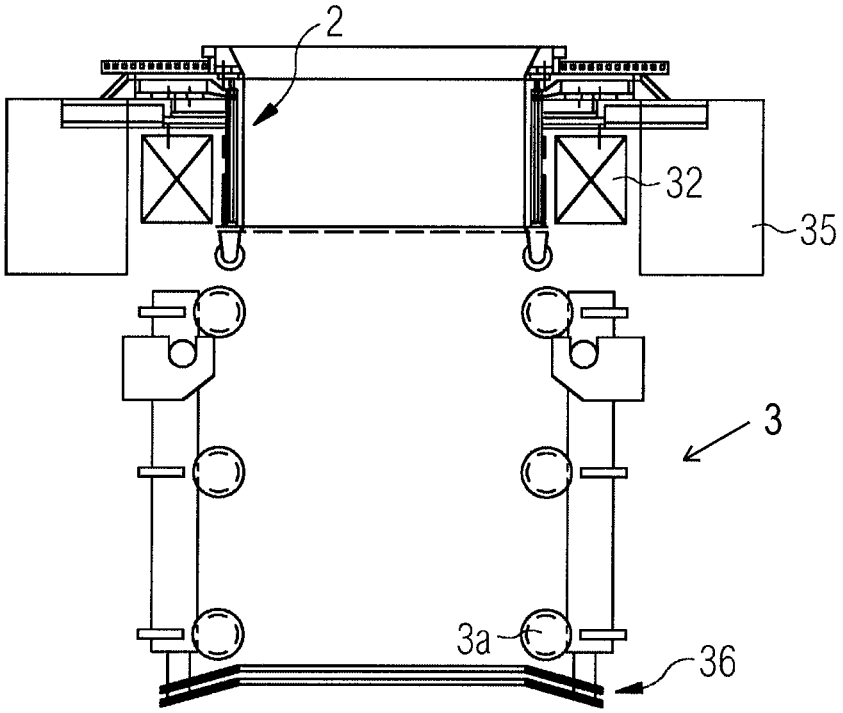
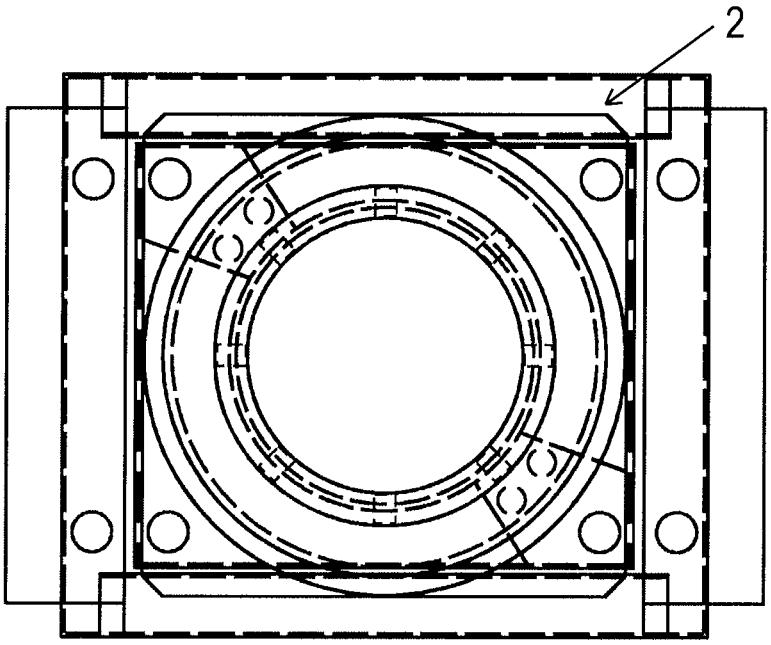
FIG 7B FIG 8A
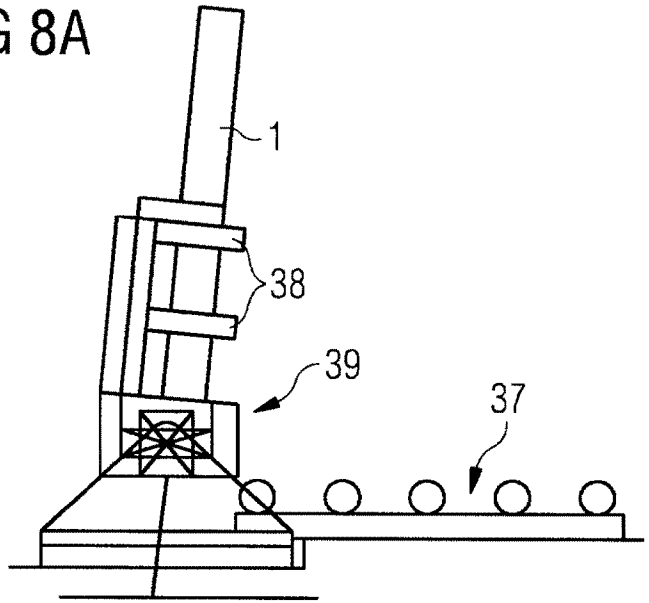
FIG 8B
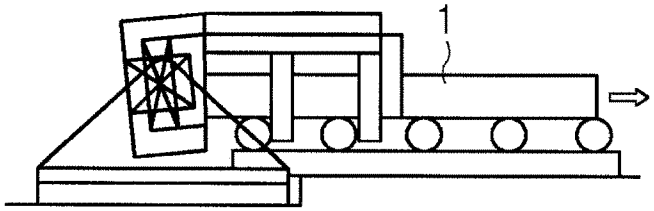
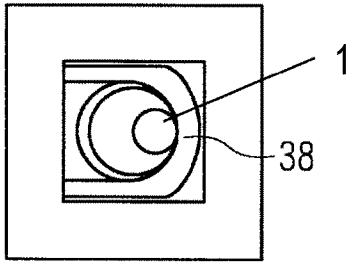
FIG 8C

SEMI-CONTINUOUS CASTING OF A STEEL STRIP

CROSS-REFERENCE TO RELATED APPLICATIONS

The present application is a 35 U.S.C. § § 371 national phase conversion of PCT/EP2015/051619, filed Jan. 27, 2015, which claims priority of European Patent Application No. 14162061.7, filed Mar. 27, 2014, the contents of which are incorporated by reference herein. The PCT International Application was published in the German language.

TECHNICAL FIELD

The present invention relates to a method for semi-continuous casting of a strand, preferably of an ingot, made of steel in a strand casting machine, and relates to a strand casting machine suitable therefor.

In this specification and claims, semi-continuous casting refers to a process wherein a strand casting machine does not continuously produce a strand, but casts the strand semi-continuously or intermittently to produce a strand and then stops casting for a period of time, and then starts casting to produce another strand, etc.

PRIOR ART

The majority of steel produced nowadays is cast into strands in continuously operated strand casting machines having a high throughput. Only about 5% of steel is cast into ingots. Ingot casting is described for example in the ASM Handbook, Volume 15: Casting, chapter "Steel Ingot Casting", pages 911-917, DOI: 10.1361/asmhba0005295. Although the proportion of liquid steel that is cast into ingots using what is known as the ingot route is small, the ingot route is very profitable on account of its suitability for special steel grades and formats.

Advantages of ingot casting are:

- high flexibility in product dimensions, favorable for small batch sizes, unique for large formats;
- suitability for special steel grades (e.g. for cold heading quality (CHQ) steels; HSLA steels; high-alloy steels having about 5% alloy content, such as Cr, Ni, Mo; chain steels; free machining steels having a high content of S, Pb, Bi; bearing steels having about 1% C, 1.2% Cr, 0.25% Ni, 0.25% Mo; etc.); and
- greater quality as regards avoidance of center segregation and porosity, in particular of thread porosity in the center of the strand.

Disadvantages of ingot casting are:

- slow but only insufficiently controllable cooling rates in the ingot mold;
- higher output losses through the severing of the head and foot part of the ingot;
- higher operating costs; and
- reduced microstructure symmetry and purity.

SUMMARY OF THE INVENTION

Tests carried out by the applicant have shown that higher quality of ingot casting with respect to center segregation and porosity is primarily caused by a slow solidification rate and by solidification, directed from the strand start toward the strand end, in the central region of the ingot. The solidification in the center takes place in a globular manner, or with an axially oriented solidification front, such that any dendrites, which may occur and form bridges in the center and impede feeding of the melt, are avoided. Thread porosity in the center is thus largely precluded. In contrast, the properties during continuous casting are just the opposite. Extremely low cooling rates as in ingot casting are not realizable in continuously operated strand casting machines, since the machine length is limited for economic reasons. The higher cooling rate associated with the solidification that tends to be directed radially from the outside inward in continuous casting causes dendritic solidification and thus center segregation and porosity. Therefore, according to the prior art, large formats which are intended to be substantially free of center segregation and porosity, in particular thread porosity, are produced via the ingot route. The higher operating costs, lower output and disadvantages in the microstructure symmetry and purity of the ingot are accepted here.

It is the object of the invention to overcome the disadvantages of the prior art and to provide a method for the semi-continuous casting of a strand, preferably of an ingot, made of steel in which the strand

- has low center segregation and porosity, and
- can nevertheless be cast rapidly, i.e. with a high throughput. As a result, the semi-continuously cast strand on the one hand is intended to have similar metallurgical properties to or even better metallurgical properties than an ingot produced by the classical ingot route; on the other hand, however, the strand is intended to be able to be produced with a similarly high throughput as in a continuously operated strand casting machine.

Finally, a strand casting machine suitable therefor is disclosed.

According to the invention, in the method for the semi-continuous casting of a strand, preferably of an ingot, made of steel in a strand casting machine, wherein the strand casting machine has a cooled open-ended mold for the primary cooling of the strand, followed by a strand guide for supporting and guiding the strand, having secondary cooling typically comprising a plurality of cooling nozzles for cooling the strand, followed in turn by tertiary cooling for cooling the strand further, the following method steps are carried out:

- starting casting in the strand casting machine, wherein liquid steel is poured into the open-ended mold closed off by a dummy bar and the liquid steel forms with the dummy bar a fully solidified strand start and then a partially solidified strand;
- extracting the partially solidified strand from the open-ended mold;
- supporting and guiding the partially solidified strand in the strand guide, wherein the partially solidified strand is cooled by the secondary cooling;
- ending casting in the strand casting machine, wherein the pouring of liquid steel into the open-ended mold is ended and a strand end forms;
- extracting the strand end from the open-ended mold;
- ending extraction, such that the strand end is located outside the open-ended mold (i.e. in the region of the secondary cooling zone or the tertiary cooling zone of the strand casting machine);
- ending secondary cooling;
- controlled or regulated cooling of the partially solidified strand until full solidification of the strand in the tertiary cooling zone of the strand casting machine, wherein the cooling takes place more strongly at the strand start and in a decreasing manner toward the strand end;

discharging the strand from the strand casting machine.

The strand casting machine used in the process is structured in three parts. The cooled open-ended mold, typically consisting of copper or a copper alloy, for primary cooling of the strand is followed by a strand guide for supporting and guiding the strand, having secondary cooling, typically comprising a plurality of single-substance nozzles (usually what are referred to as water only nozzles) and/or multi-substance nozzles (usually what are referred to as air-mist nozzles), for cooling the partially solidified strand shell, and a tertiary cooling zone for cooling the strand further.

In order to avoid bending or reverse bending of the strand, it is advantageous for the strand casting machine to be configured as a vertical strand casting machine having a vertical mold, a vertical strand guide and a vertical tertiary cooling zone.

The method according to the invention proceeds as follows: at the start of molding in the strand casting machine, liquid steel is poured (typically from a metallurgical vessel, such as a ladle or tundish) into the open-ended mold closed off by a dummy bar. The liquid steel forms with the dummy bar a fully solidified strand start and a partially solidified strand (i.e. a solidified strand shell and a liquid core) following the strand start. The through-flow from the metallurgical vessel into the open-ended mold can be set for example via a slide-valve closure or a stopper drive. Subsequently, the partially solidified strand is extracted from the open-ended mold, wherein the meniscus in the mold, which is set by the inflow of liquid steel into the mold and the extraction of the partially solidified strand by driven strand guide rollers, is kept more or less constant. After the open-ended mold, the partially solidified strand is supported in the strand guide, guided and cooled further by the secondary cooling. In particular, at relatively high casting rates, it is advantageous for the secondary cooling to have a plurality of cooling nozzles. At slow casting rates, however, cooling by radiation may already be sufficient to form a viable strand shell. The cooling intensities in the primary and secondary cooling are set, depending on the extraction rate, such that the shell of the partially solidified strand withstands the maximum ferrostatic pressure that occurs in the strand casting machine. When the strand has reached the desired length or the desired weight, the casting operation is ended, for example by closing the metallurgical vessel. As a result, a typically not fully solidified strand end of the strand forms. The strand end is now extracted from the open-ended mold at least to such an extent that it comes to rest in the region of the secondary cooling or tertiary cooling of the strand casting machine. At the latest when the strand end has passed through the secondary cooling zone the secondary cooling is ended. In contrast to continuous casting, the partially solidified strand is now cooled slowly, in a controlled or regulated manner in the tertiary cooling zone of the strand casting machine until full solidification. In the process, the cooling takes place in a controlled manner, which is more strongly in the foot region (i.e. in the region of the strand start) and in a decreasing manner toward the strand head (i.e. in the region of the strand end). Thus, a solidification front that is directed from the bottom upward is brought about in the central region. In the center of the partially solidified strand, either a globular or a dendritic microstructure having only extremely little segregation and porosity is established. In the case of dendritic solidification, the dendrites cannot coalesce in the strand center, with the result that thread porosity in the strand center is avoided. Finally, the fully solidified strand is discharged from the strand casting machine.

The cooling of the partially solidified strand in the tertiary cooling zone takes place in either a controlled or a regulated manner. The surface temperature of the strand, or preferably a microstructure composition calculated in real time in a 2- or 3-dimensional model containing the heat equation for the strand and optionally taking into consideration the processes during microstructure transformation, in the center of the strand, can be used as a setpoint value for the cooling. As a result, the cooling and microstructure formation in the strand can be set very precisely. In the tertiary cooling, the strand is cooled primarily by heat radiation and optionally by convection. Spray cooling is typically not required.

As a result of the slow cooling of the strand, any necessary annealing treatments of the strand for the purpose of stress relief and further structural improvement can already be effected in the tertiary cooling zone of the strand casting machine.

Advantageously, the slow, regulated or controlled, cooling of the strand is influenced by at least one of the following measures:

a) influencing of the thermal insulation of the strand, b) heating of the strand, c) surface cooling of the strand.

As a result of the targeted influencing of the thermal insulation, the cooling can be set more strongly at the strand start than at the strand end without supplying additional energy. As a result of targeted heating of the strand, this can be ensured with supplying additional energy. Finally, too slow cooling of the strand optionally present only locally, can be remedied by surface cooling of the strand.

In order to prevent the partially solidified strand from cooling too rapidly in the tertiary cooling zone, it is advantageous for the partially solidified strand, and preferably the lateral surface thereof, to be heated in the tertiary cooling zone by a, preferably inductive, heating device. Alternatively, however, the strand can also be heated by burners.

Although too slow cooling of the partially solidified strand should not occur according to the invention, locally too slow cooling can be prevented when the partially solidified strand is cooled in the tertiary cooling zone by a, preferably displaceable, cooling device.

It is particularly advantageous for the heating device to be displaceable in the extraction direction of the strand casting machine. As a result, the temperature of the strand can be influenced only by a single heating device, without devices arranged in a distributed manner being required for this purpose.

In order to set the solidification, it is particularly advantageous for the partially solidified strand to be protected from cooling too rapidly in the tertiary cooling zone by thermal insulation. It is advantageous for the thermal insulation to be preheated before the start of casting. Particularly effective thermal insulation, which additionally promotes the degassing of the not yet solidified melt and furthermore protects against scaling, consists in keeping the strand under a vacuum or under a protective atmosphere.

For thermal insulation, it is advantageous for the insulation effect either to be preset statically or to be set in a controlled or regulated manner during operation. The setting can take place, for example, by way of pivotable insulation slats. The insulation slats can be set at different, but statically constant, pivot angles along the strand length during the tertiary cooling phase. However, it is also possible for the pivot angles, depending on the production program, to be adjusted dynamically during the cooling phase. For example, the pivot angles can be set to be larger at the bottom—i.e. in the region of the strand start—than at the top, with the result that the strand end region is cooled more slowly than the strand start region.

In order to increase the throughput in a semi-continuous casting operation, it is extremely advantageous if, after the strand end has passed through the secondary cooling, the cooled open-ended mold, preferably the open-ended mold and the secondary cooling zone, are separated (for example lifted) from the tertiary cooling zone and the separated components are displaced transversely to the extraction direction of the strand casting machine to another casting station, i.e. to a further cooling zone. In the further cooling zone, a further strand can be cast, while the previously produced strand is cooled slowly in the tertiary cooling zone. As a result of these measures, the high quality of ingot casting can be combined with the high productivity of continuous casting.

Following the separation of the cooled open-ended mold, or of the open-ended mold together with the secondary cooling zone, from the tertiary cooling zone, it is advantageous for the strand end to be protected by thermal insulation from cooling too rapidly.

Furthermore, it is advantageous for the strand end to be heated by a heating device, in particular an inductive heating device, an arc furnace, a plasma heater or by the burning off of exothermic covering powder.

As a result of the insulation and heating of the strand end, the upper region of the strand is kept with a liquid heel until the end of full solidification and the feeding of the melt into the strand center is ensured. As a result of these measures, high quality is achieved and excessive funnel formation in the strand end is avoided. However, similar measures are also possible in the lower region of the strand. As a result of these measures, the output losses are reduced, since only a relatively short section of the strand start and strand end has to be severed.

In order to achieve a regular internal structure, a stirring device such as a stirring coil is advantageous. This is conveniently displaceable along the strand axis. Alternatively, the partially solidified strand can be rotated about its own axis alternately in the clockwise direction and the counterclockwise direction in the tertiary cooling zone. As a result of the reversal in direction, particularly intimate mixing in the interior of the strand is ensured.

In order that the cast strand acquires a viable shell as quickly as possible and, as a result, the length of the secondary cooling can be kept as short as possible, it is advantageous for the strand to have a round cross section. A similar effect can also be achieved with a strand having a rounded triangular, rounded rectangular etc. cross section.

The strand casting machine according to the invention comprises

- a device for extracting a strand from an open-ended mold and a device for discharging the strand from the strand casting machine,
- the cooled open-ended mold for the primary cooling of the strand is followed by
- a strand guide for supporting and guiding the strand, having a secondary cooling zone, which typically comprises a plurality of cooling nozzles, for cooling the strand, followed in turn by
- a tertiary cooling zone for cooling the strand further,
- wherein the tertiary cooling zone has a, preferably inductive, heating device, which is in particular displaceable in the extraction direction of the strand casting machine, for the controlled or regulated cooling of the partially solidified strand.

Instead of the heating device which is displaceable in the tertiary cooling zone, the strand casting machine according to the invention can also have thermal insulation that is statically presettable or settable dynamically (i.e. during operation) in a controlled or regulated manner.

As a result of the heating device, the lateral surface of the strand can be heated, with the result that the cooling (and as a result the microstructure formation) in the central region of the partially solidified strand can be set very precisely in the tertiary cooling zone of the strand casting machine.

In order to allow the slow cooling of the partially solidified strand with low energy consumption for the heating device, it is advantageous for the tertiary cooling zone to have thermal insulation, which is in particular statically settable or settable dynamically in a controlled or regulated manner.

It is expedient for the open-ended mold, the secondary cooling zone and the tertiary cooling zone to be arranged in-line.

The productivity of the semi-continuous casting machine is significantly increased if the strand casting machine has a plurality of tertiary cooling zones that are offset transversely to the extraction direction of the strand casting machine, wherein the machine head of the strand casting machine, comprising the open-ended mold and preferably the secondary cooling zone is connectable to and separable from a tertiary cooling zone and at least the machine head is displaceable transversely to the extraction direction. As described above, a single machine head can serve a plurality of tertiary cooling zones, such that a high throughput is achieved in spite of the slow cooling of the partially solidified strand.

Preferably, the machine head is displaced to a further tertiary cooling zone while the strand is stationary. As a result, the controlled or regulated, slow cooling in the central region of the strand is not disturbed. However, alternatively, the strand, optionally together with the tertiary cooling, can also be moved away from the machine head.

During the adjustment of the thermal insulation, it is advantageous for the adjustable thermal insulation to have at least one insulation panel (also referred to as slat), and advantageously a plurality thereof, which is displaceable in the extraction direction of the strand casting machine or pivotable with respect to the extraction direction. As a result, the cooling rate of the partially solidified strand can be set passively, i.e. without additional energy input.

A plurality of strands having a small format can be produced simultaneously if the machine head of the strand casting machine has a plurality of cooled open-ended molds and, arranged thereafter, a plurality of strand guides having secondary cooling zones.

A simple and robust strand casting machine has a strand extraction carriage for extracting the strand, wherein the strand extraction carriage is displaceable in the extraction direction, for example by way of spindle drives, rack and pinion drives or cylinder drives.

In this case, the strand start is supported on the strand extraction carriage via the dummy bar.

In one embodiment of the strand casting machine according to the invention, the strand extraction carriage is connected to the machine head, wherein the strand extraction carriage is displaceable together with the machine head transversely to the extraction direction. In this case, after the end of casting, the cast strand is set down for example on a platform on the hall floor and the machine head is displaced together with the strand extraction carriage to another tertiary cooling. The slow cooling of the set-down strand can be ensured for example by a thermal hood fitted over the strand.

Alternatively, it would also be possible for the machine head to be stationary and for the cast strand to be displaceable transversely to the extraction direction. In this case, the cast strand is set down for example on a platform, wherein the platform can be displaced together with the strand to a further tertiary cooling zone.

BRIEF DESCRIPTION OF THE DRAWINGS

Further advantages and features of the present invention can be gathered from the following description of nonlimiting exemplary embodiments, wherein, in the figures:

FIGS. 7A and 7B show a machine head of a strand casting machine according to the invention respectively in FIG. 7A in an elevational view in the direction of FIG. 6A and a top view in FIG. 7B.

FIGS. 8A and 8B schematically respectively show an upright strand before discharge from the tertiary cooling zone and then discharge of a fully solidified strand from the tertiary cooling zone.

FIG. 8C is a top view of FIG. 8A

DESCRIPTION OF THE EMBODIMENTS

FIGS. 1A-1F show the method steps in the semi-continuous casting of a strand 1 in a strand casting machine.

Figure 1A:
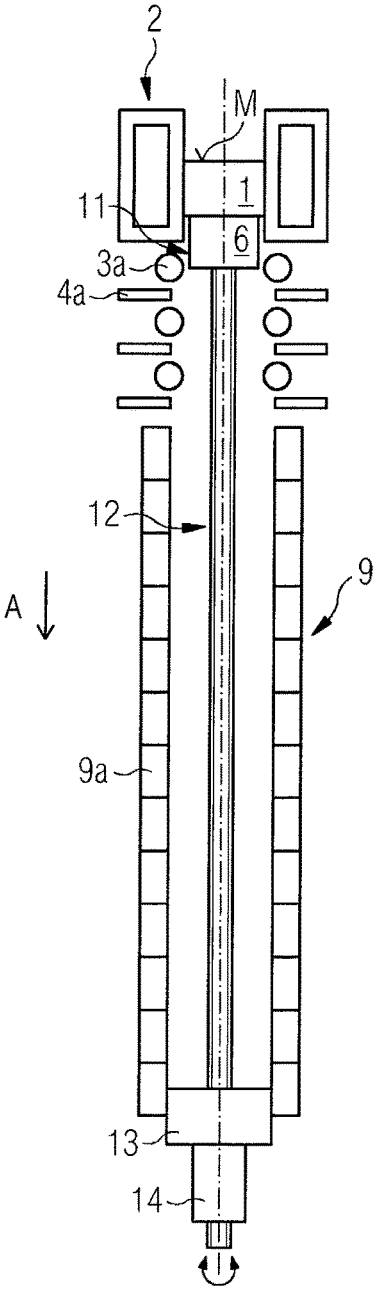
FIG. 1 schematically shows, in sub-FIGS. 1A-1F, the method steps in the semi-continuous casting of an ingot made of steel.

In FIG. 1A, liquid steel is poured from a ladle tundish (not shown separately) via a submerged entry nozzle into a cooled open-ended mold 2, wherein, at the start of casting in the strand casting machine, the open-ended mold 2 is closed off in a fluid-tight manner by the dummy bar 6 such that a meniscus M is set in the mold. As a result of the liquid steel joining to the head of the dummy bar 6, a fully solidified strand start 1*a* (see FIG. 1C) is formed. As a result of the primary cooling of the cooled open-ended mold 2, the partially solidified strand 1*b* in FIG. 1B following the fully solidified strand start 1*a* counter to the extraction direction A is not fully solidified but has merely a thin strand shell and a liquid core. In order to keep the meniscus M in the mold 2 more or less constant in spite of the liquid steel flowing in via the submerged entry nozzle, the strand 1 is extracted from the mold 2. To this end, in FIG. 1A, the strand casting machine has a strand extraction carriage 11 which comprises the dummy bar 6 itself, a threaded spindle 12, a threaded nut 13 and a motor 14 for displacing the strand extraction carriage 11 in the extraction direction A. The motor 14 is connected to the threaded nut 13 via a transmission and the threaded spindle 12 and has a drive shaft for the threaded spindle 12.

Figure 1B:
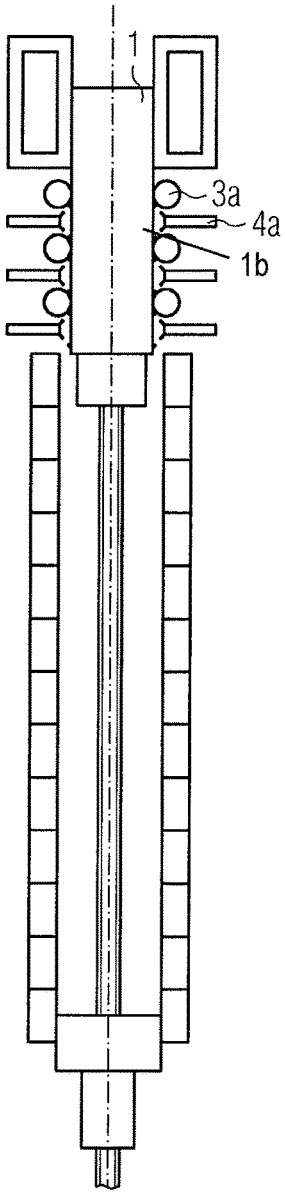

In FIG. 1B, the strand 1 has already been extracted further from the open-ended mold 2, wherein the strand 1 is supported in the strand guide 3 following the mold 2 by a plurality of strand guide rollers 3*a*, guided and cooled by a plurality of cooling nozzles 4*a* in the secondary cooling 4. In the process, the strand 1 forms a viable strand shell which can withstand the ferrostatic pressure. In this way, breaching of the strand 1 is prevented.

Figure 1C:
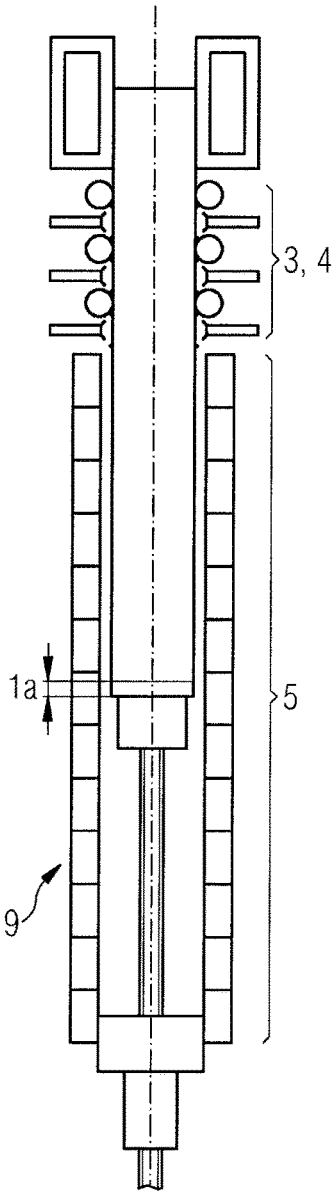
Figure 2A:
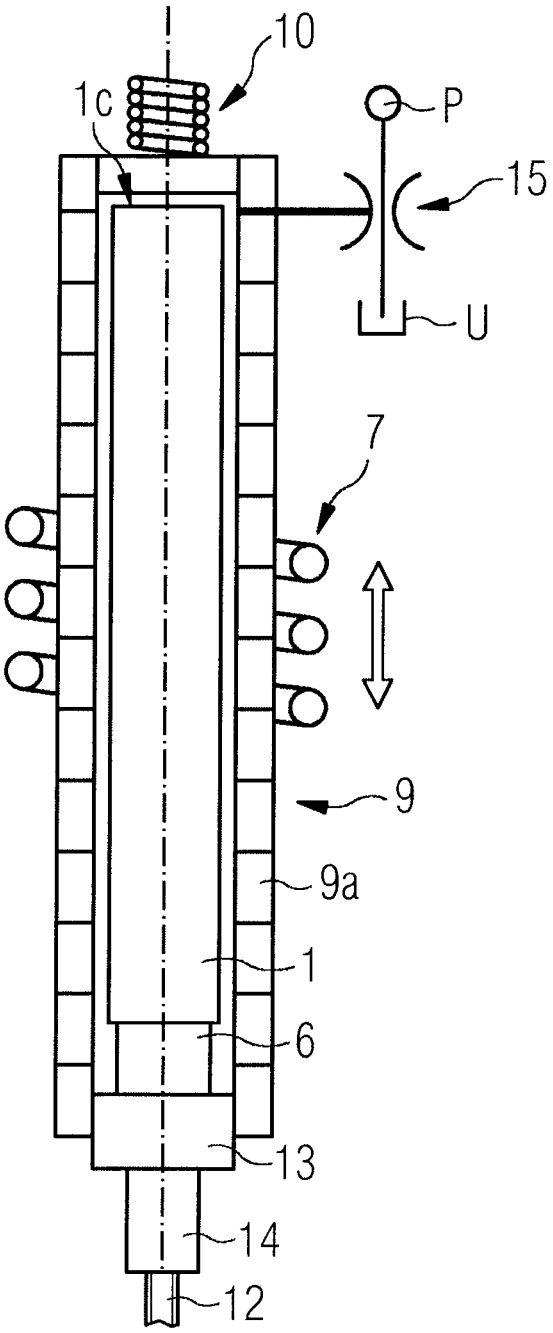
FIGS. 2A and 2B show two alternative embodiments of tertiary cooling for the semi-continuous casting of an ingot made of steel.

In FIG. 1C, the strand start 1*a* has already passed through the secondary cooling 3 of the strand casting machine and has passed into the tertiary cooling zone 5. In the tertiary cooling zone 5, the strand 1 is cooled further slowly in a controlled or regulated manner, such that full solidification takes place in the center of the partially solidified strand 1*b* with an upwardly oriented direction. As a result, either a globular or at least a dendritic microstructure avoiding thread porosity forms. In order to prevent the partially solidified strand 1*b* from cooling too rapidly, the tertiary cooling zone 5 has thermal insulation 9 and a heating device 7, illustrated in FIG. 1F. FIG. 2*a* shows an example of thermal insulation 9 for tertiary cooling, wherein the atmosphere between the strand 1 and the thermal insulation hood 9 is evacuated by a vacuum pump (in this case a jet pump 15). To this end, a pressure port of the jet pump 15 is connected to a compressed air system and the suction port of the jet pump 15 is connected to the space inside the thermal insulation 9. By way of this measure, oxidation, i.e. scaling, of the strand 1 is additionally prevented. Moreover, as a result of the vacuum treatment, the not yet fully solidified melt in the strand is degassed. The thermal insulation 9 has a plurality of insulation panels 9*a* (FIGS. 2A and 2B, which can be closed (opening angle 0°), opened (opening angle 90°) or partially opened (90°>opening angle>0°) independently of one another.

Figure 1D:
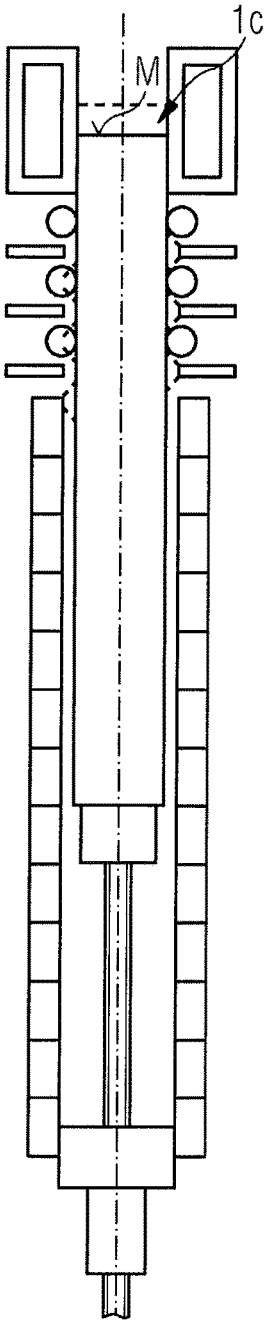
Figure 1E:
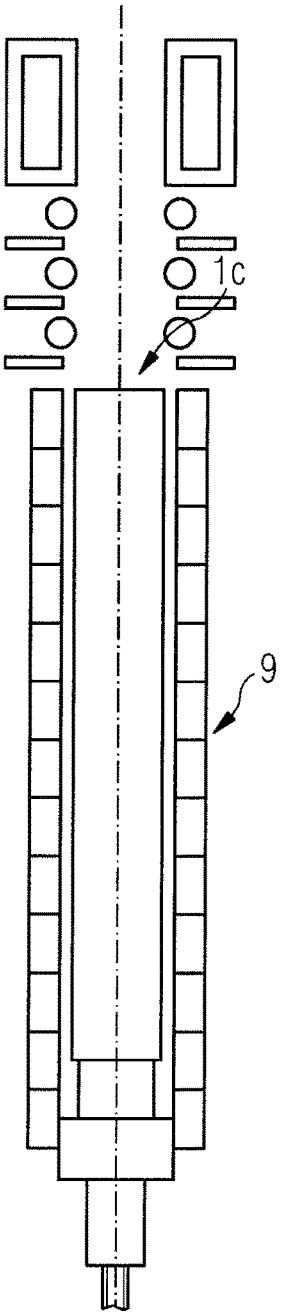
Figure 1F:
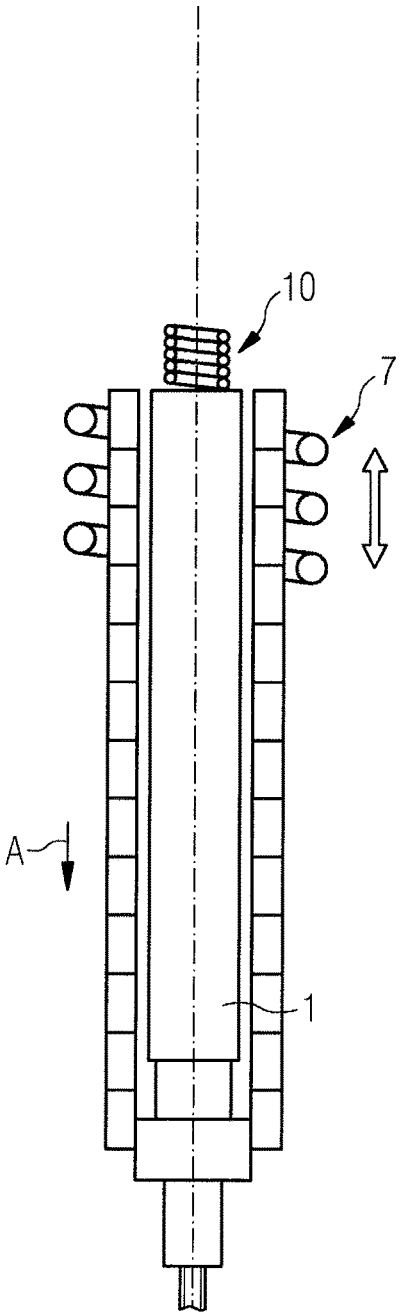

In FIG. 1D, casting in the strand casting machine has been ended, and so a strand end 1*c* forms. As a result of the extraction of the strand end 1*c* from the mold 2, the meniscus M of FIG. 1D is below the mold 2, illustrated by a dashed line, according to method steps in FIGS. 1A-1C.

Fig, 1E Shows the situation after the strand end 1*c* of the strand 1 has passed through the secondary cooling zone 4, the secondary cooling, has been ended and the strand end 1*c*terminates flush with the upper end of the tertiary cooling zone 5. In the tertiary cooling zone 5, the slow, controlled or regulated cooling of the partially solidified strand 1*b* is ensured by the thermal insulation 9 and by the heating of the strand by the heating device 7 that is displaceable in the extraction direction A (see FIG. 1F). After the separation and lifting of the machine head, comprising the open-ended mold 2, the strand guide 3 and the secondary cooling 4, away from the tertiary cooling 5, the strand end 1*c* is heated by inductive head heating 10, so as to prevent the strand end 1*c* from cooling too rapidly.

According to FIGS. 1A-1F, a, for example round steel strand 1 having a diameter of 1200 mm and a length of 10 m was produced. The extraction rate of the strand 1 from the open-ended mold 2 is 0.25 m/min. As a result of the thermal insulation 9 and the reheating of the strand 1 by the displaceable heating device 7, the complete solidification of the strand 1 is achieved only after 13 h. The casting of the strand, without the slow cooling of the strand in the tertiary cooling zone 5, had already been ended after 46 min, however. Since casting ended rapidly compared with the slow full solidification, it is advantageous, in order to increase the throughput of the semi-continuous casting method, for the machine head (no longer illustrated in FIG. 1F) to be separated from the tertiary cooling zone 5 and displaced transversely to the extraction direction A to a further tertiary cooling zone 5. There, a new strand can be cast, while the strand 1 illustrated in FIG. 1F continues to be cooled slowly. After the slow cooling of the strand 1 until its complete solidification in FIG. 8A, the strand is tipped down from its upright orientation of FIG. 8A to its position on the roller bed 37, as described below discharged from the strand casting machine, for example by a device according to FIGS. 8A and 8B.

FIG. 2A illustrates a first alternative embodiment of the tertiary cooling zone 5 from FIG. 1. In this case, the space between the strand 1 and the thermal insulation 9 is evacuated by a jet pump 15, with the result that good thermal insulation and slow cooling are achieved. Furthermore, the surface of the strand 1 is protected against scaling and the residual melt is degassed. The jet pump is simple and wear-free. The pressure port thereof is connected to a compressed air port P and the suction port thereof is connected to the space within the tertiary cooling zone that is to be evacuated. Blowing off can take place against ambient pressure U. The inductive head heating 10 is advantageous compared with plasma heating, since the magnetic field also acts through the thermal insulation of the strand end 1*c*.

Figure 2B:
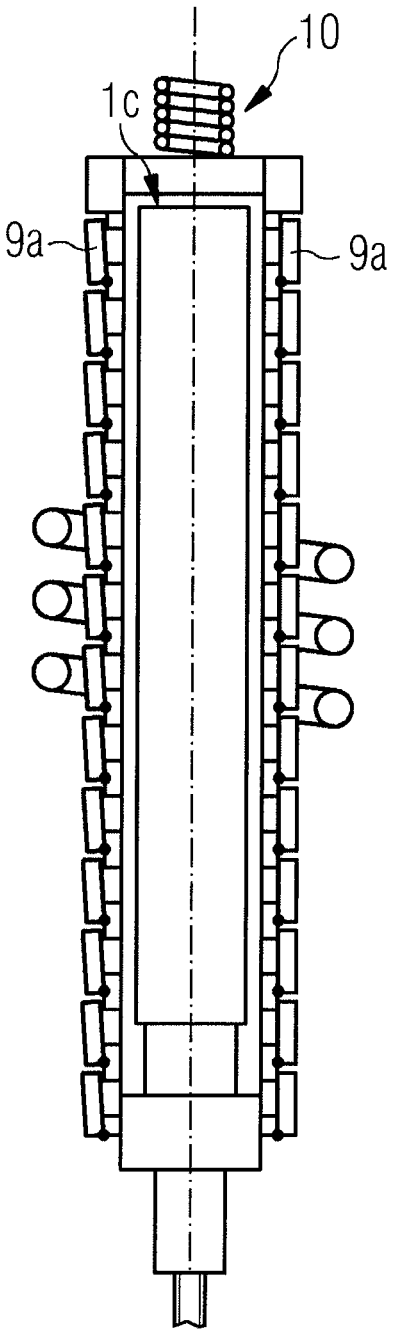

FIG. 2B shows a second alternative of the tertiary cooling zone 5 from FIG. 1. In this case, the insulation slats 9*a* of the thermal insulation 9 are pivotable with respect to the extraction direction, such that the air exchange between the ambient air and the strand 1 in the interior of the tertiary cooling zone 9 is settable. Merely to illustrate the function of the insulation slats 9*a*, the insulation slats 9*a* have been illustrated closed on the right-hand side of the strand 1 and opened through 10° with respect to the extraction direction A on the left-hand side. The adjustment of the slats 9*a* can take place either manually or by way of actuators.

Figure 3B:
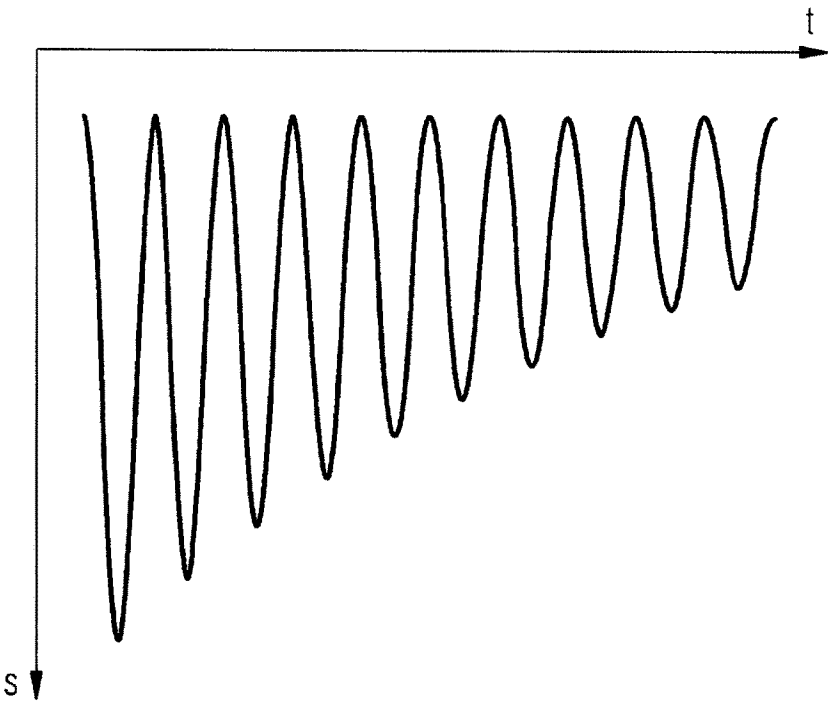
FIGS. 3A and 3B show the chronological sequence of a heating unit for heating an ingot in tertiary cooling.
Figure 3A:
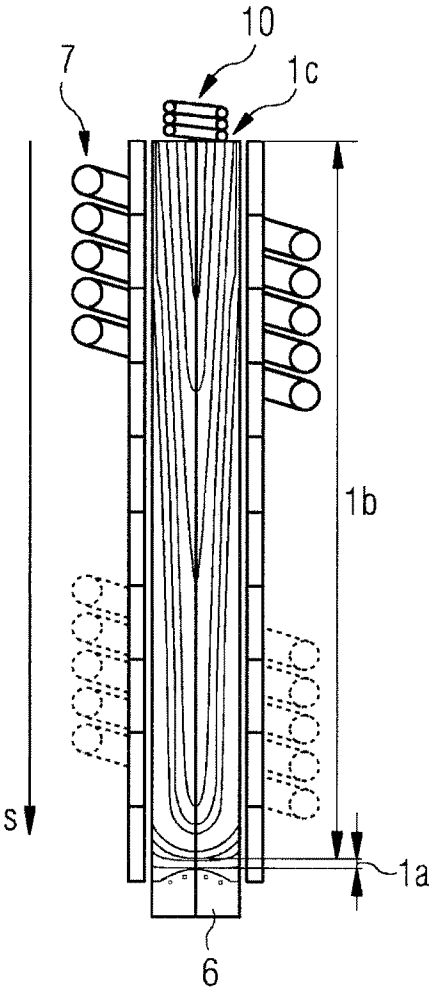

FIG. 3A schematically shows the chronological sequence of the displacement path s of the inductive heating device 7 for reheating the lateral surface of the strand 1. In this case, the heating device 7 is illustrated by solid lines in the upper region of the strand 1 and by dashed lines in the lower region. FIG. 3B shows a reciprocating path of movement of the heating device 7. Since the solidification front moves from the bottom upward during cooling (i.e. from the strand start 1*a* to the strand end 1*c*), the displacement path s of the heating device 7 also shortens over time. The displacement downward toward 1*a* in FIG. 3A is greater at the start of tertiary cooling and smaller toward the end of the cooling, since the solidification is faster or earlier from bottom to top in FIGS. 3A and 3B. As an alternative to a displaceable heating device 7, a plurality of heating devices (e.g. burners) arranged in a manner distributed along the length of the tertiary cooling zone 5 in the extraction direction A could also be used.

Figures 4, 4A, 4B, 4C:
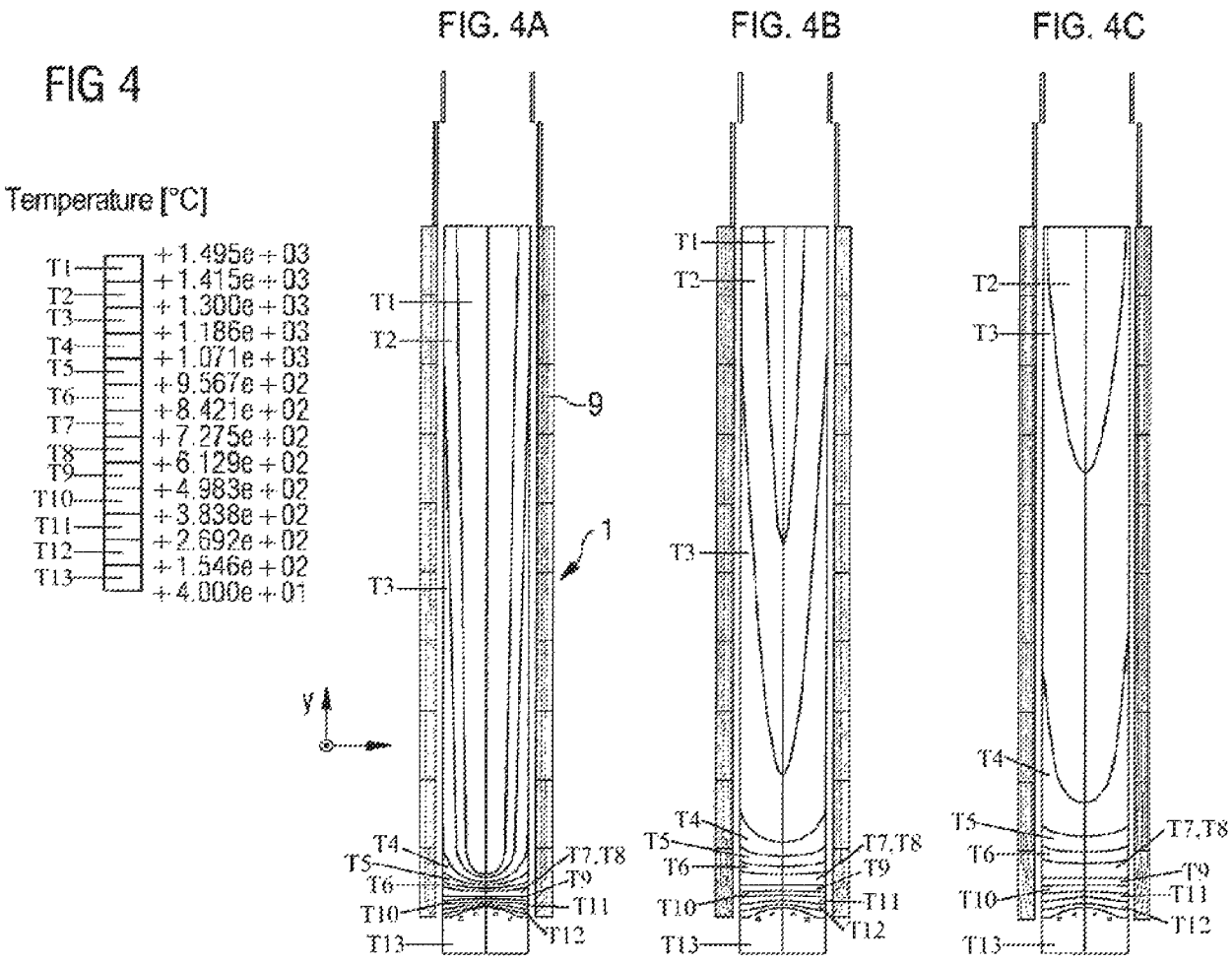
FIG. 4 shows the temperatures at various zones dining the cooling of the strand 1 in the tertiary cooling zone 5. It refers to the zones in Figs.4A, 4B and 4C.
FIGS. 4A, 4B and 4C show temperature changes in the molded and cooled strand after progressively longer periods of time of cooling.
Figure 5:
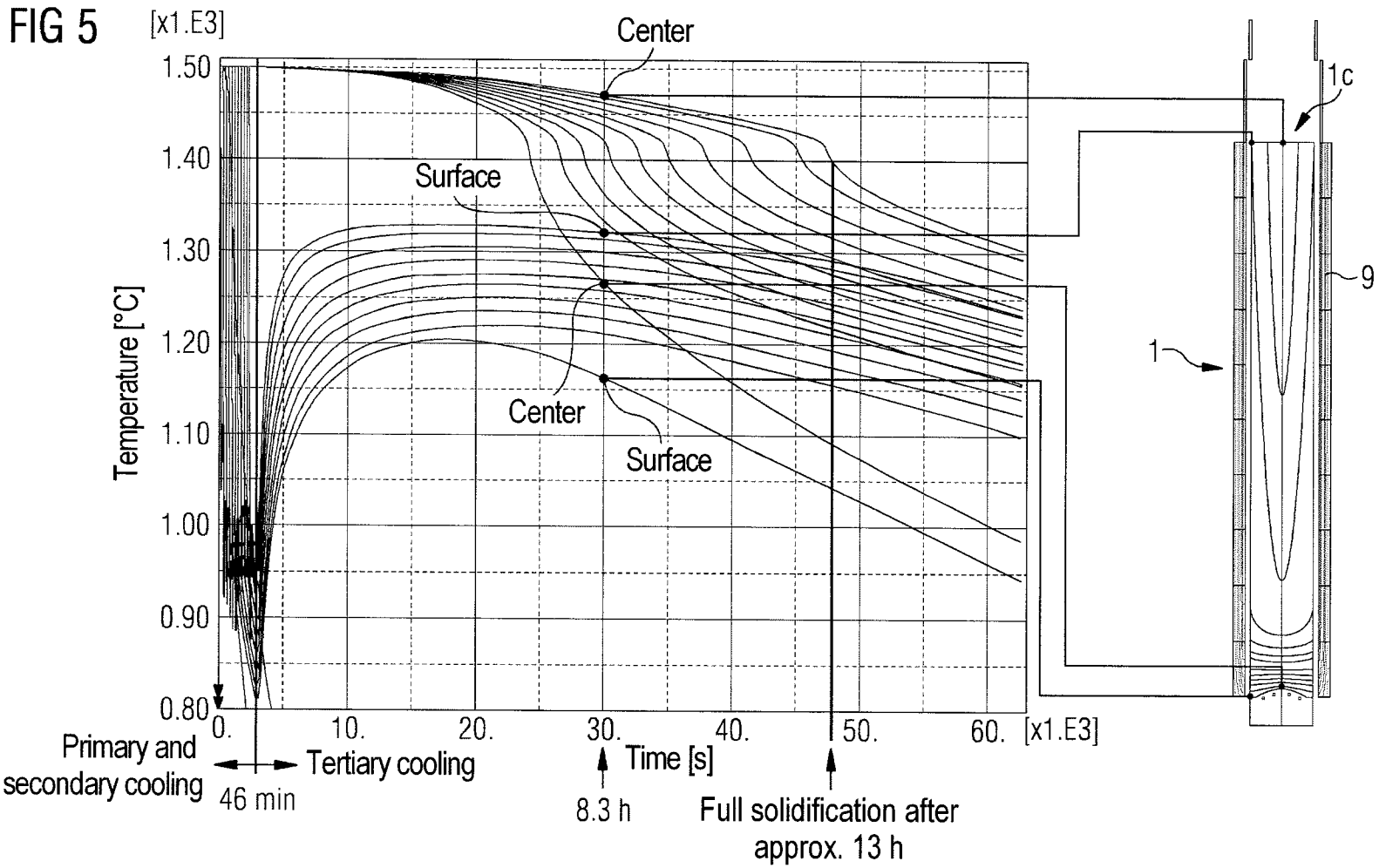
FIG. 5 shows the temperature profiles over time with respect to FIGS. 4, 4A, 4B and 4C.

FIG. 4 shows the temperatures in °C of the strand I produced according to FIG. 1 in the sectional illustration, 3 h after the start of casting FIG. 4A, 8.3 h after the start of casting FIG. 413 and at full solidification of the strand 1. approx. 13 h after the start of casting FIG. 4C. The numbered lines in FIG. 4 provide information in the following way: The numbers T1-T13 represent the respective temperatures in °C at the zones defined by the lines in FIGS. 4A, 48 and 4C. The first line. "1.495e +03" means 1.495×103, which is 1495. This also guides a reader to understand. the other temperatures in FIG-. 4. The chronological sequence of the temperatures of the strand 1 at different positions on the surface and in the center of the strand are illustrated in FIG. 5. It is apparent therefrom that the casting of the strand and thus also the primary and secondary cooling is ended 46 min after the start of casting and subsequently the strand 1 is cooled in a controlled manner only by the tertiary cooling 5.

Figure 6A:
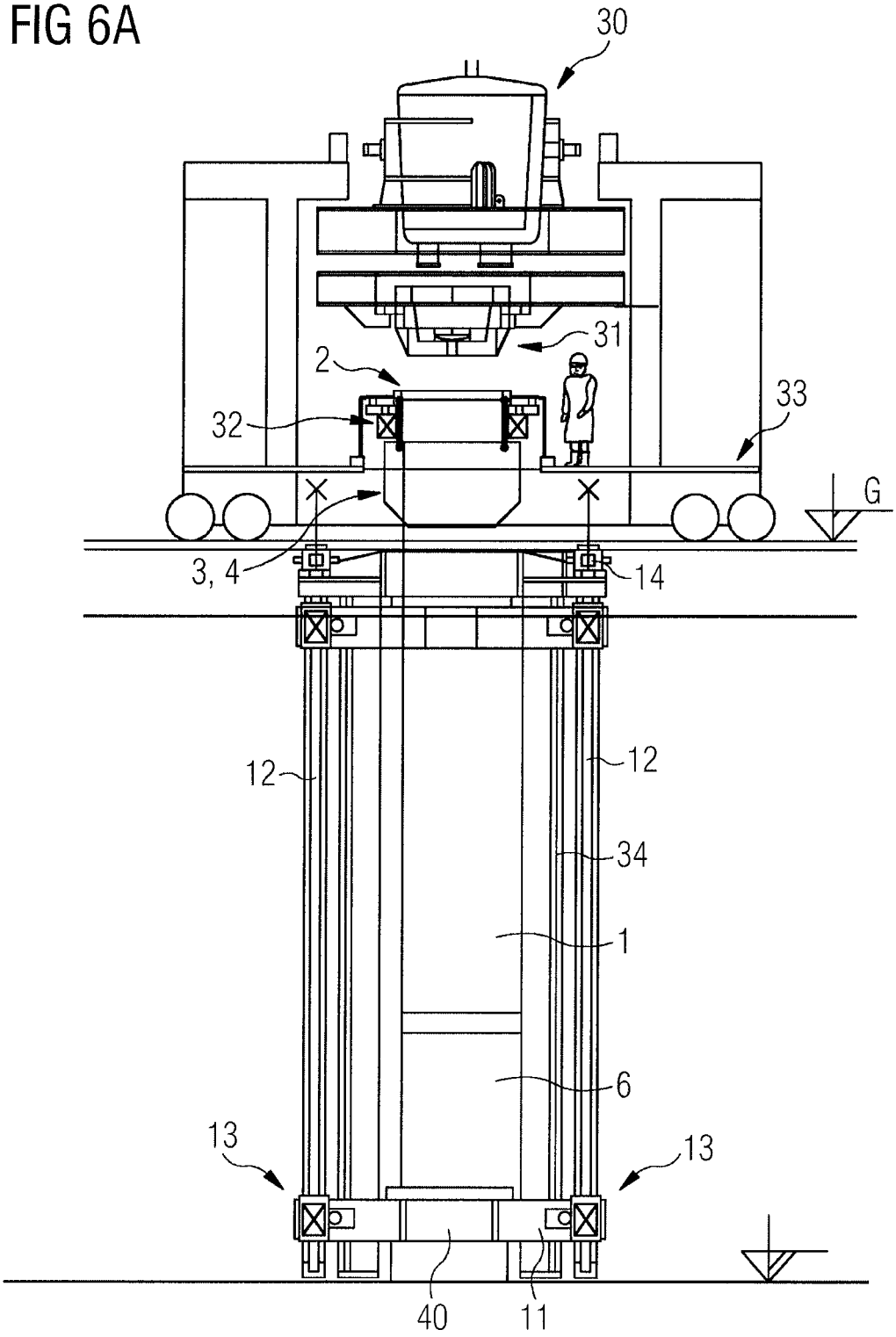
FIG. 6A shows an elevational, partially, cross-sectional side view
Figure 6B:
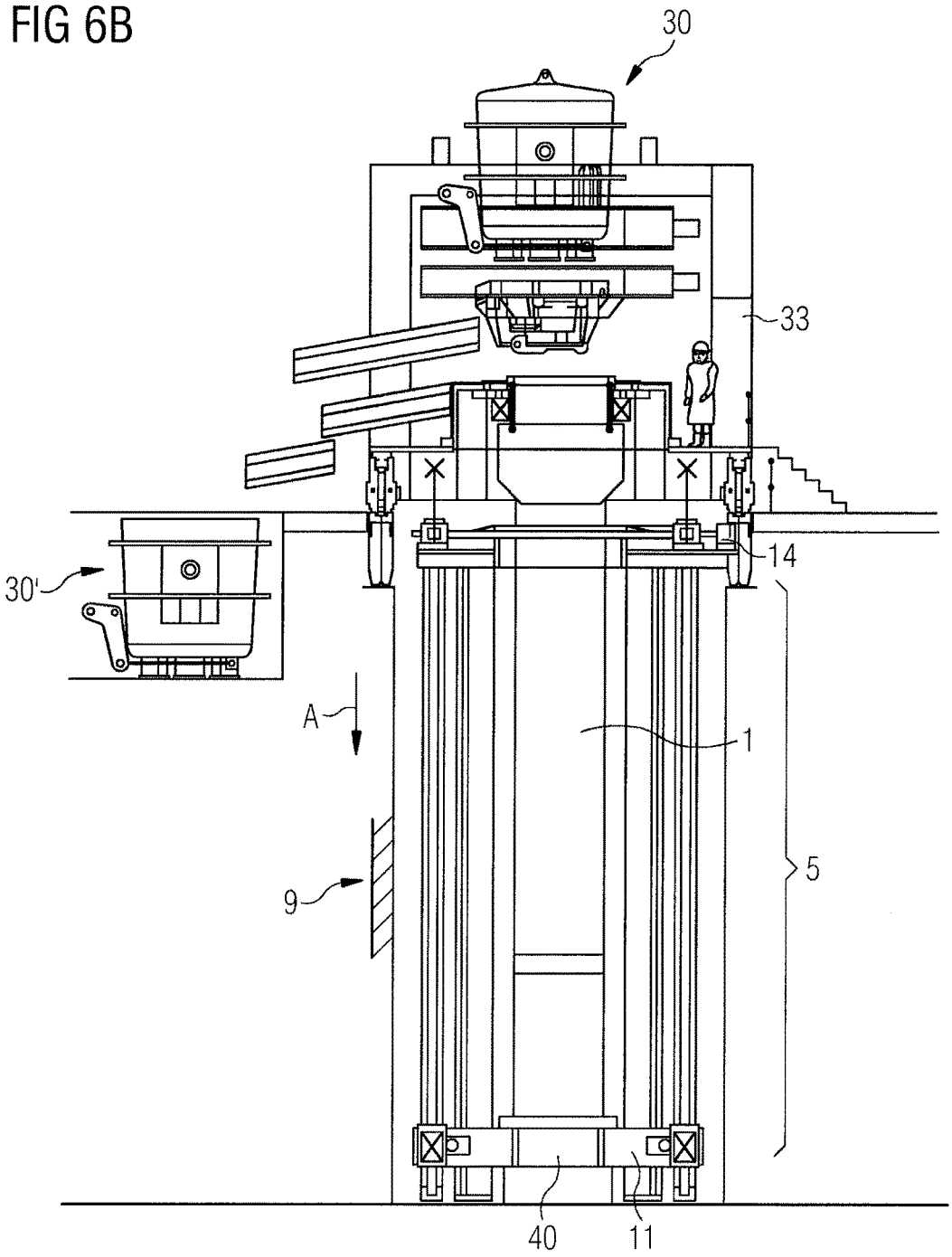
FIG. 6B shows a front view of a strand casting machine according to the invention.

FIGS. 6*a* and 6*b* illustrate a vertical strand casting machine according to the invention in two views. The liquid steel is poured from a ladle 30 via a shroud tube into the tundish 31, and subsequently the melt flows via a submerged entry nozzle (SEN, not illustrated) into the open-ended mold 2. As a result of the primary cooling in the mold 2, a partially solidified strand 1 having a viable strand shell forms. In the mold 2, the melt is influenced yet further by an optional stirring device 32. The strand 1 is supported in the strand guide 3, guided and cooled further in the secondary cooling zone 4. At least the open-ended mold 2, the stirring coil 32, the strand guide 3 having the secondary cooling zone 4, and optionally also the tertiary cooling zone 5, are displaceable on a casting car 33 on the casting platform G. The strand 1, together with the dummy bar 6, is extracted from the open-ended mold 2 via the strand extraction carriage 11. To this end, the strand extraction carriage 11 is driven via four threaded spindles 12 and guided by additional guide rails 34, wherein a motor is connected to the threaded nut 13 via a transmission and the threaded spindle 12. After the casting operation has been ended and the strand 1 has been set down on the anvil 40, the casting car 33 can be displaced transversely to the extraction direction A to a further casting station, since the casting of the partially solidified strand, i.e. without the tertiary cooling of the strand 1, requires much less time than the tertiary cooling of the strand 1 until the full solidification thereof. In the tertiary cooling zone 5, the strand 1 is cooled slowly by the thermal insulation 9 and optionally by a heating device (not illustrated here), such that the solidification in the center of the strand takes place with an upwardly oriented solidification front.

A more detailed illustration of the machine head of the strand casting machine from FIGS. 6A and 6B is illustrated in FIGS. 7A and 7B.

FIG. 7A shows a strand guide 3 between the open ended mold 2 which provides primary cooling of the strand. The strand guide rollers 3*a* on the guide direct the strand out of the guide and past water stripper 36.

FIGS. 8A and 8B schematically show an embodiment of the discharging of the fully solidified strand 1 from the tertiary cooling zone. The strand 1 is supported laterally by two brackets 38, such that even very different diameters (see outline in FIG. 8C) can be cast in the strand casting machine. In FIG. 8C, the strand 1 has already been pivoted out with respect to the vertical and is resting on the brackets 38. In FIG. 8B, the strand 1 is deposited via the pivot drive 39 on a roller bed 37 where it can be removed in the direction of the arrow.

Although the invention has been described and illustrated in more detail by the preferred exemplary embodiments, the invention is not limited by the disclosed examples and other variants can be derived therefrom by a person skilled in the art without departing from the scope of protection.

LIST OF REFERENCE SIGNS

1 Strand
1*a* Strand start
1*b* Partially solidified strand
1*c* Strand end
2 Open-ended mold, primary cooling

3 Strand guide
3*a* Strand guide rollers
4 Secondary cooling, secondary cooling zone
4*a* Cooling nozzle
5 Tertiary cooling, tertiary cooling zone
6 Dummy bar
7 Heating device
9 Thermal insulation
9*a* Insulation panel
10 Head heating
11 Strand extraction carriage
12 Threaded spindle
13 Threaded nut
14 Motor
15 Jet pump
30, 30' Ladle
31 Tundish
32 Stirring coil
33 Casting car
34 Guide rail
35 Oscillating device
36 Water stripper
37 Roller bed
38 Bracket
39 Pivot drive
40 Anvil
A Extraction direction
G Casting platform
M Meniscus
P Pressure in a compressed air system
s Displacement path
U Ambient pressure

The invention claimed is:

1. A method for semi-continuous casting of a strand made of steel in a strand casting machine, wherein the strand casting machine comprises:

a cooled open-ended mold configured for primary cooling of the strand, followed by a strand guide for supporting and guiding movement of the strand, and having secondary cooling located and configured for cooling the strand, followed by a tertiary cooling zone for cooling the strand, the method comprising the steps of:

starting casting in the strand casting machine, comprising pouring liquid steel into the open-ended mold while closing off the mold by a dummy bar and so that the liquid steel forms with the dummy bar a fully solidified strand start area which is then followed by a partially solidified strand;

extracting the partially solidified strand from the open-ended mold;

supporting and guiding the partially solidified strand in the strand guide, where the partially solidified strand is cooled by the secondary cooling;

at the end of the casting in the strand casting machine, ending the pouring of liquid steel into the open-ended mold and forming a strand end;

extracting the strand end from the open-ended mold;

ending the extraction of the strand end, such that the strand end is then located outside the open-ended mold;

then ending the secondary cooling;

receiving and retaining all of the partially solidified strand in the tertiary cooling zone;

providing controlled or regulated cooling of the partially solidified strand in the tertiary cooling zone until full solidification of the partially solidified strand in the tertiary cooling zone of the strand casting machine, wherein the cooling in the tertiary cooling zone takes place more strongly at the strand start area and in a decreasing manner toward the strand end; and discharging the strand from the strand casting machine.

2. The method as claimed in claim 1, further comprising setting the cooling of the partially solidified strand in the tertiary cooling zone by influencing at least one from the group consisting of:

thermally insulating the strand;

heating the strand; and surface cooling the strand.

3. The method as claimed in claim 2, further comprising heating the partially solidified strand in the tertiary cooling zone by a heating device for setting the cooling of the strand.

4. The method as claimed in claim 3, wherein the heating device is displaceable in an extraction direction of the strand casting machine and displacing the heating device in the extraction direction.

5. The method as claimed in claim 2, further comprising protecting the partially solidified strand from cooling too rapidly in the tertiary cooling zone by thermal insulation.

6. The method as claimed in claim 5, further comprising setting an insulating effect of the thermal insulation.

7. The method as claimed in claim 2, further comprising heating the strand end by head heating.

8. The method as claimed in claim 2, further comprising cooling the surface of the partially solidified strand in the tertiary cooling zone by a cooling device.

9. The method as claimed in claim 2, further comprising stirring the partially solidified strand in the tertiary cooling zone by a stirring coil that is stationary or displaceable in the extraction direction, or rotating the partially solidified strand about its own axis alternately in a clockwise direction and a counterclockwise direction in the tertiary cooling zone.

10. A strand casting machine for carrying out the method as claimed in claim 1 comprising:

an open-ended mold configured for receiving liquid steel and for cooling the liquid steel to form a strand of steel in the mold;

a device for extracting the strand from the open-ended mold and a device for discharging the strand from the strand casting machine;

the open-ended mold is cooled for providing primary cooling of the strand in the mold;

a strand guide following the mold and configured for supporting and guiding the strand out of the mold, in an extraction direction, the strand guide having a secondary cooling zone for cooling the strand;

a tertiary cooling zone following the strand guide for cooling the strand further, the tertiary cooling zone having a heating device which is displaceable in the extraction direction of the strand casting machine, for the controlled or regulated further cooling of the partially solidified strand, wherein the tertiary cooling zone is configured to receive and retain all of the partially solidified strand.

11. The strand casting machine as claimed in claim 10, further comprising the tertiary cooling zone having thermal insulation that is statically settable or settable in a controlled or regulated manner.

12. The strand casting machine as claimed in claim 11, further comprising the adjustable thermal insulation comprises at least one insulation panel which is displaceable in the extraction direction or is pivotable with respect to the extraction direction.

13. The strand casting machine as claimed in claim 11, further comprising the strand casting machine comprises a strand extraction carriage configured for extracting the strand, from the secondary cooling zone, wherein the strand extraction carriage is displaceable in the extraction direction.

14. The strand casting machine as claimed in claim 13, further comprising the strand extraction carriage is connected to the machine head and both the extraction carriage and the machine head are displaceable transversely to the extraction direction.

15. The strand casting machine as claimed in claim 10, further comprising a plurality of the tertiary cooling zones offset transversely to the extraction direction of the strand casting machine; and a machine head of the strand casting machine, comprising the open-ended mold and the secondary cooling zone, is connectable to and separable from the tertiary cooling zone.

16. The strand casting machine as claimed in claim 15, further comprising the plurality of the tertiary cooling zones are arranged one after another in an arcuate, circular, or linear arrangement for receiving the strand from the machine head.

17. The strand casting machine as claimed in claim 15, further comprising the machine head is stationary and the strand is displaceable transversely to the extraction direction.

18. The strand casting machine as claimed in claim 10, further comprising a plurality of the tertiary cooling zones offset transversely to the extraction direction of the strand casting machine; and a machine head of the strand casting machine, comprising the open-ended mold.

* * * * *